US005800239A

United States Patent [19]

Cohen

[11] Patent Number: 5,800,239

[45] Date of Patent: Sep. 1, 1998

[54] BUILDING BLOCK TOY SET

[76] Inventor: Avi Cohen, 7210 112th St., Apt. 1J, Forrest Hills, N.Y. 11375

[21] Appl. No.: 752,002

[22] Filed: Nov. 15, 1996

[51] Int. Cl.[6] ..... A63H 33/04; A63H 33/06; A63H 33/08

[52] U.S. Cl. ..... 446/85; 446/118; 446/124

[58] Field of Search ..... 446/85, 118, 122, 446/124, 126; D21/108

[56] References Cited

U.S. PATENT DOCUMENTS

| | | | |
|---|---|---|---|
| 729,918 | 6/1903 | Braun | 446/124 |
| 1,985,992 | 1/1935 | Hayman | 446/122 |
| 2,440,836 | 5/1948 | Turngren | 446/124 |
| 2,735,146 | 2/1956 | Purviance | 446/122 |
| 3,157,582 | 11/1964 | Babule et al. | 446/122 |
| 3,576,936 | 5/1971 | Fischer | 446/122 |
| 3,863,918 | 2/1975 | Kramer | 446/85 |
| 3,921,330 | 11/1975 | Drieze | 446/124 |
| 5,064,399 | 11/1991 | Klitsner et al. | 446/308 |
| 5,281,185 | 1/1994 | Lee | 446/488 |
| 5,482,491 | 1/1996 | Kichijyo | 446/112 |

FOREIGN PATENT DOCUMENTS

| | | | |
|---|---|---|---|
| 2252565 | 10/1972 | Germany | 446/122 |
| 92/19341 | 11/1992 | WIPO | 446/122 |

*Primary Examiner*—Robert A. Hafer
*Assistant Examiner*—Laura Fossum
*Attorney, Agent, or Firm*—Ezra Sutton

[57] ABSTRACT

A toy building block set, that includes a plurality of building blocks each having a plurality of sides for interconnection with the sides of other building blocks; and at least one side of each building block having a semicircular-shaped channel formed therein for alignment with the semicircular-shaped channel of another building block to form a circular channel. In addition, there is a plurality of cylindrical rod-like members each for placement in one of the circular channels of the aligned building blocks and for extending from the aligned building blocks to support other building blocks in the toy building block set.

25 Claims, 7 Drawing Sheets

BUILDING BLOCK TOY SET

FIELD OF THE INVENTION

This invention relates to a building block toy set to effect sculpturing of various configurations and desired geometric structures. More particularly, to a building block toy of various geometric shapes having grooved sides in combination with connecting rods assembled together in an improvised manner to create various sculptural forms.

BACKGROUND OF THE INVENTION

Building block toys have been in existence for many centuries from simple cubical blocks having designs thereon such as letters, numbers, animals, etc. to complex geometric shapes having various interlocking means to form a structure that can have infinite structural forms, such as in a Leggo™ toy. Building block toys in the past fifty years have provided an educational forum for a child's development of imagination and creativity in the construction of sculptures.

Many of these building block toys have very complex interconnecting means, in the form of slotted pegs, metal springs, metal screws and the like which prove to be awkward for a given child's dexterity in joining the toy blocks together. This could then frustrate a child in not wanting to play further with type of educational building block toy because of its non-ease of use; and possibly tamper the child's imaginative, dexterous and organizational development of his/her mental and physiological skills in playing with this type of building block toy.

There remains a need for a new and improved building block toy having a variety of geometric shapes which have grooved sides, in combination with a connecting rod for a simple ease of joining any two or more building blocks together. In addition, the building block toy set of this invention will further develop a child's dexterity, imagination and creativity because of its simple design and uncomplicated securement means which addresses both the problems of ease of use and effectiveness in organizational skills for that child in creating an infinite number of various sculptural designs.

DESCRIPTION OF THE PRIOR ART

Building block toy sets of various designs using varied interlocking methods and materials of construction have been disclosed in the prior art. For example, U.S. Pat. No. 1,103,781 discloses a toy building set for the reproduction of iron technical constructions. The toy building set includes a plurality of right-angled and oblique-angled metal triangles. The aforementioned metal triangles when in use are placed side by side to form a two dimensional structure. These metal triangles are joined together by a small metal nut and bolt. This '781 prior art patent has a nut and bolt for holding fixedly only one other metal frame, wherein the connecting rods of the present invention can connect with a plurality of building blocks, on the part of the connecting rod which extends outwardly. Therefore, the structure of the present invention is different.

U.S. Pat. No. 1,472,536 discloses an educational building block toy set comprising of a plurality of cubical bodies having small apertures located at the corners, edges, and face surfaces, respectively for receiving of a slotted peg. This prior art patent depicts a complete circular cut-out for receiving the entire slotted peg; and each circular cut-out is perpendicular to the surface face, such that each peg can support only one other block. Thus, the structure of the present invention is different than the prior art since it can connect and support a plurality of building blocks on the second part of the connecting rod which extends outwardly.

U.S. Pat. No. 1,294,446 discloses a building block toy set that include a plurality of multi-shaped blocks in the form of cubes, pyramids, and the like having dove tail grooves on the surfaces of the aforementioned blocks. These blocks are joined by a resilient connecting member formed of a bent wire which are designed to enter the grooved section of one block.

Each wire member can support only one other block. Thus, the structure of the present invention is different than the prior art since it can connect and support a plurality of building blocks on the second part of the connecting rod which extends outwardly.

None of the prior art patents disclose the structure of the present invention of building blocks having grooved sides in which elongated connecting rods fit into the grooves for supporting a second set of building blocks.

Accordingly, it is an object of the present invention to provide a building block toy set that is easy to use where interconnection of two or more building blocks is done by the use of connecting rod member.

Another object of the present invention is to provide a building block toy having a grooved side for connecting with a rod member in which to join two or more building blocks together for creating an infinite number of structural designs.

Another object of the present invention is to provide a building block toy set wherein the building blocks are in the geometric shapes of triangles, cubes, rectangles, trapezoids, parallelograms, and polygons.

Another object of the present invention is to provide a building block toy set wherein the building blocks are solid or hollow and are made of materials such as plastic, metal, ceramic or wood.

Another object of the present invention is to provide a building block toy set wherein the connecting rod member has a cross-sectional geometric shape of a circle, oval, square, rectangle, parallelogram, octagon, star, and even-sided polygon.

Another object of the present invention is to provide a building block toy set wherein the connecting rod members are solid or hollow and are made of materials such as plastic, metal, ceramic or wood.

A further object of the present invention is to provide a building block toy set wherein the use of the connecting rod members enables the builder to extend the connecting rod members from a toy set of aligned building blocks to support other aligned building blocks within the same toy set.

A still further object of the present invention is to provide a building block toy set which can be mass produced in an automated and economical manner; is very durable and long lasting; and is readily affordable by the consumer.

SUMMARY OF THE INVENTION

In accordance with the present invention, there is provided a toy building block set, that includes a plurality of building blocks each having a plurality of sides for interconnection with the sides of other building blocks; and there is at least one side of each building block having a semicircular-shaped channel formed therein for alignment with the semicircular-shaped channel of another building block to form a circular channel. In addition, there is a plurality of cylindrical rod-like members each for placement in one of the circular channels of the aligned building blocks and for extending from the aligned building blocks to support other building blocks in the toy building block set.

BRIEF DESCRIPTION OF THE DRAWINGS

Further objects, features, and advantages of the present invention will become apparent upon consideration of the detailed description of the presently-preferred embodiments, when taken in conjunction with the accompanying drawings wherein.

DETAILED DESCRIPTION OF THE PREFERRED AND ALTERNATE EMBODIMENTS

A toy building block set 10, 100, 200, 300, 400, 500, 600, and 700 of the preferred and alternate embodiments of the present invention are represented in detail in FIGS. 1 to 10.

PREFERRED EMBODIMENT 10

Figure 1:
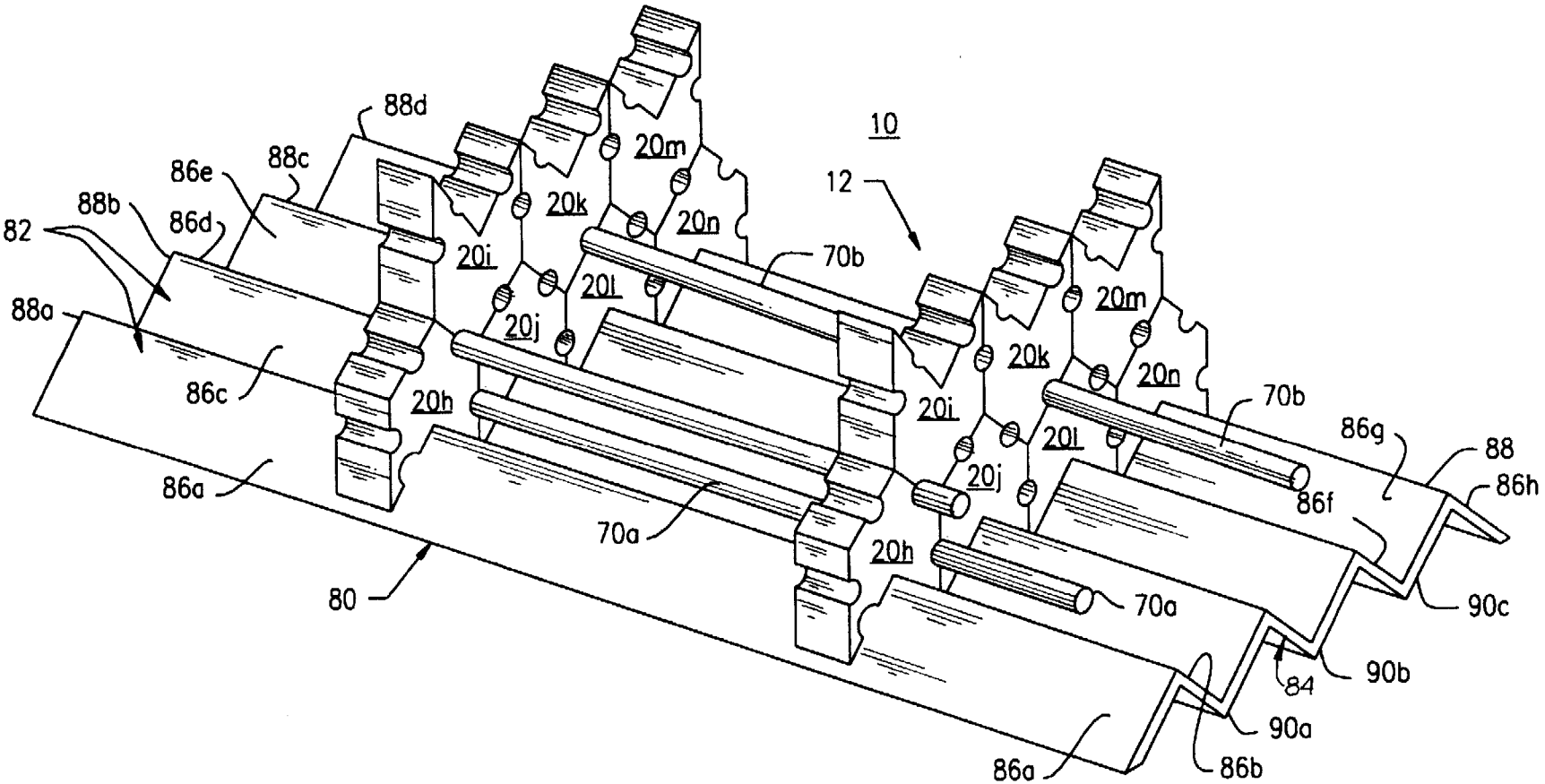
FIG. 1 is a perspective view of the toy building block set of the preferred embodiment of the present invention showing a plurality of solid building blocks and connecting rods in an assembled state being held on a support member.
Figure 3:
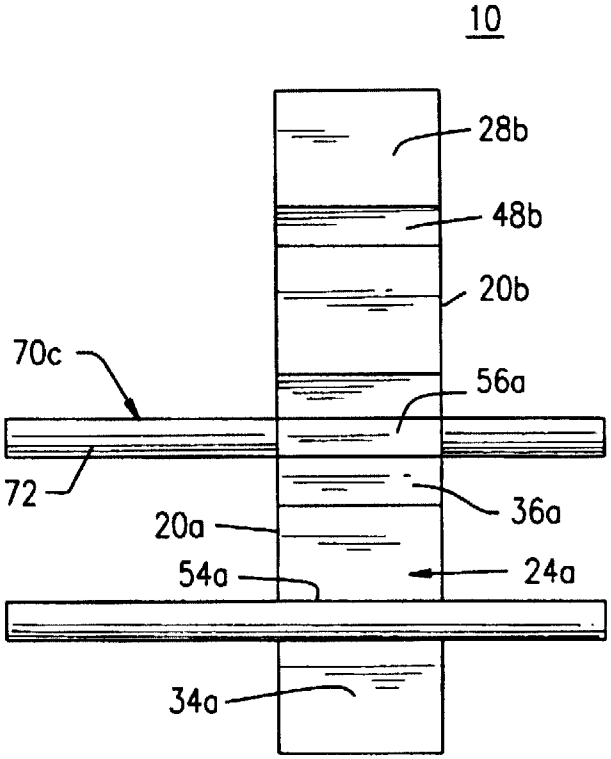
FIG. 3 is a side elevational view of the toy building block set of the preferred embodiment of the present invention showing a plurality of solid building blocks joined together by a plurality of cylindrical connecting rod-like members.
Figure 2:
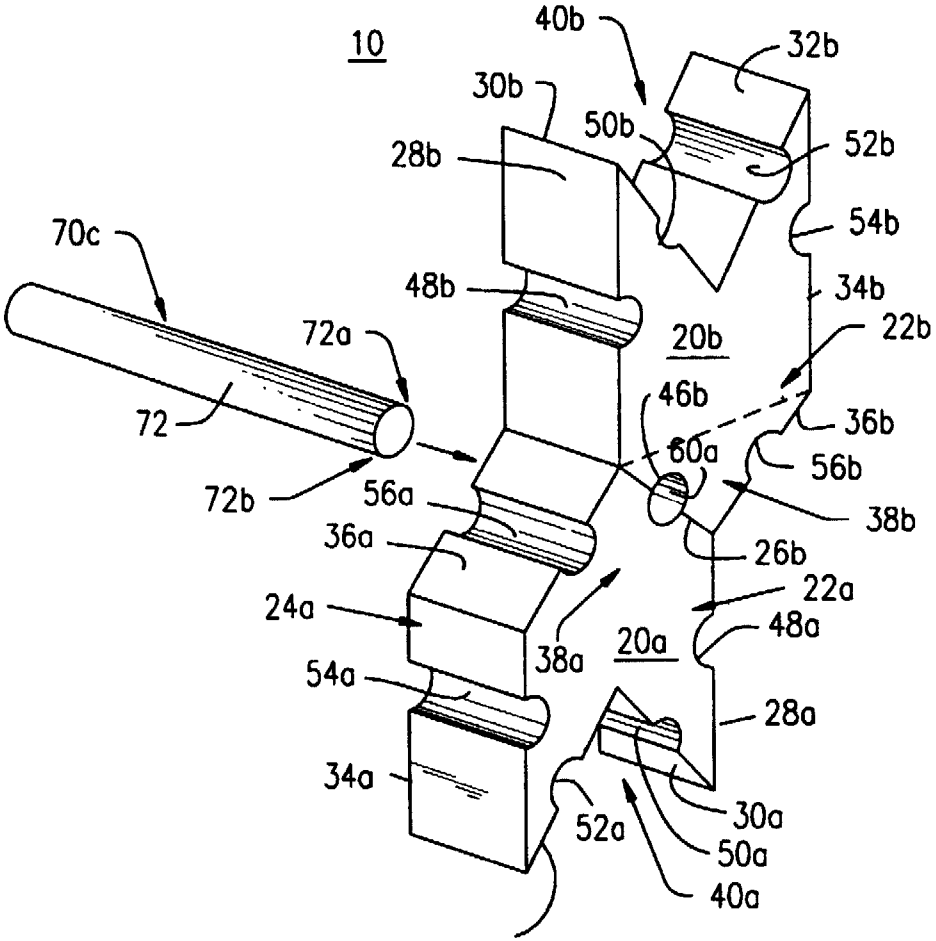
FIG. 2 is a perspective view of the toy building block set of the preferred embodiment of the present invention showing a pair of solid building blocks being joined by a cylindrical connecting rod-like member.

As shown in FIGS. 1, 2, and 3, toy building block set 10 includes a plurality of solid building blocks 20*a* to 20*n*. Each building block 20 having a front surface 22, a rear surface 24 and side surfaces 26, 28, 30, 32, 34, and 36. Each side surface 26 to 36 includes a centrally located, semi-circular shaped channel 46, 48, 50, 52, 54, and 56, respectively. When two or more building blocks 20*a* and 20*b* are joined and placed adjacently together, as shown in FIGS. 1 and 2, such that side surfaces 26*a* and 26*b* are adjacently facing and in contact with each other, so that two matching semi-circular shaped channels 46*a* and 46*b* are joined and placed together to form a circular opening 60. The solid building blocks 20*a* to 20*n* of toy set 10 can be made of construction materials that include plastic, metal, wood or ceramic.

Building blocks 20*a* and 20*b* have an extending triangular section 38*a* and 38*b* (designated by a dotted line) and a recessed triangular opening 40*a* and 40*b* for interfitting with each other, such that when they interfit with each other, there is more stability to a finite block formation when joining blocks 20*a* to 20*g* together.

As shown in FIGS. 1, 2, and 3, toy building block set 10 also includes a plurality of cylindrical connecting rod members 70*a*, 70*b*, and 70*c*, wherein each is used for the placement within one of the circular openings 60, formed by the matching of semicircular channels 46*a* with 46*b*; 48*a* with 54*c*; and 56*d* with 56*e*; of the two or more aligned building blocks 20*a*, 20*b*, 20*c*, 20*d*, and 20*e*. Connecting rod members 70*a*, 70*b*, and 70*c* are also used for extending from the aligned building blocks 20*a*, 20*b*, 20*d*, and 20*e* to support other building blocks 20*h*, 20*i*, 20*j*, 20*k*, and 20*l* in the toy set 10, as shown in FIG. 1. Connecting rod member 70*a*, as shown in FIG. 2, has a circular outer surface 72 with semicircular shaped sections 72*a* and 72*b* for fitting into semi-circular channels 46*a* and 46*b* of opening 60 on the aligned building blocks 20*a* and 20*b*. Connecting rod members 70*a*, 70*b*, and 70*c* can be made of construction materials that include plastic, metal, wood or ceramic.

In addition, building block toy set 10 includes an accordion shaped support member (base holder) 80 for holding of a plurality of solid building blocks 20*a* to 20*n*, as depicted in FIG. 1 of the drawings. Support member 80 includes a top surface 82 and a bottom surface 84 and a plurality of angled walls 86*a* to 86*h* being connected at their upper ends 88 and lower ends 90 to form an angled wall 86*a* with 86*b*, 86*b* with 86*c*, 86*c* with 86*d*, etc. Support member 80 can be made of construction materials that include plastic or metal.

FIRST ALTERNATE EMBODIMENT 100

Figure 4:
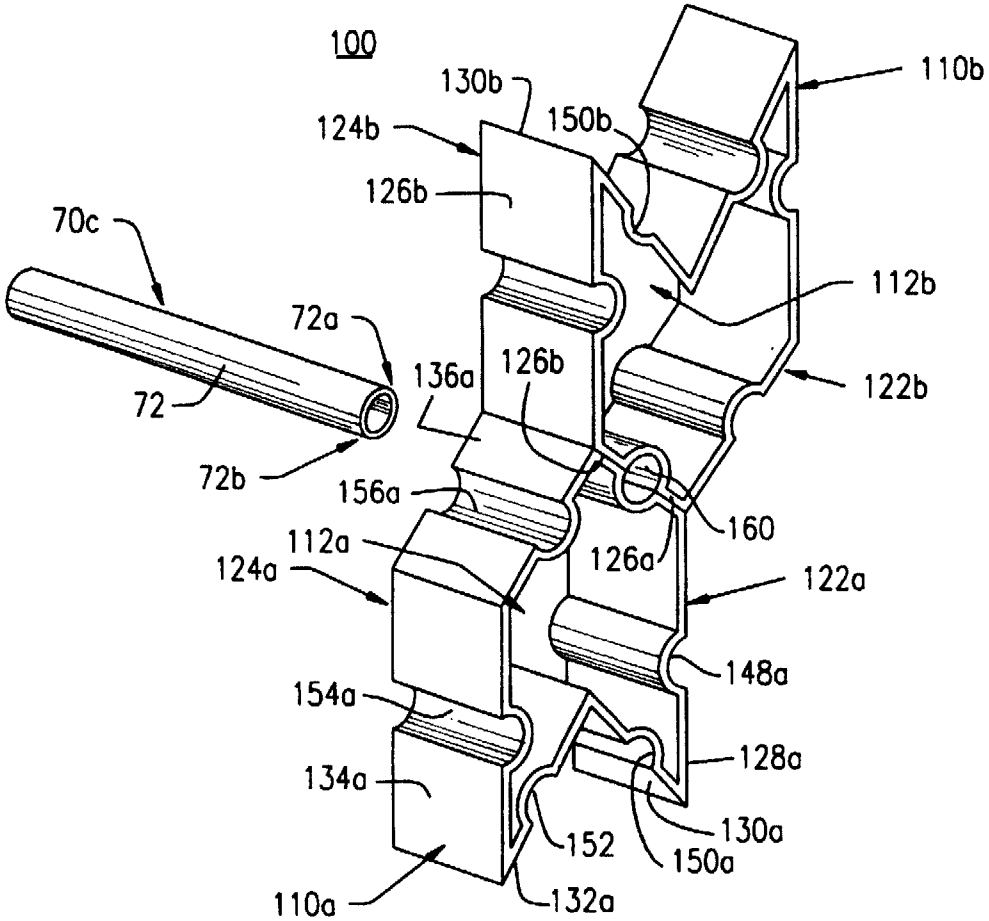
FIG. 4 is a perspective view of the toy building block set of the first alternate embodiment of the present invention showing a pair of hollow building blocks being joined by a cylindrical connecting rod-like member.
Figure 5:
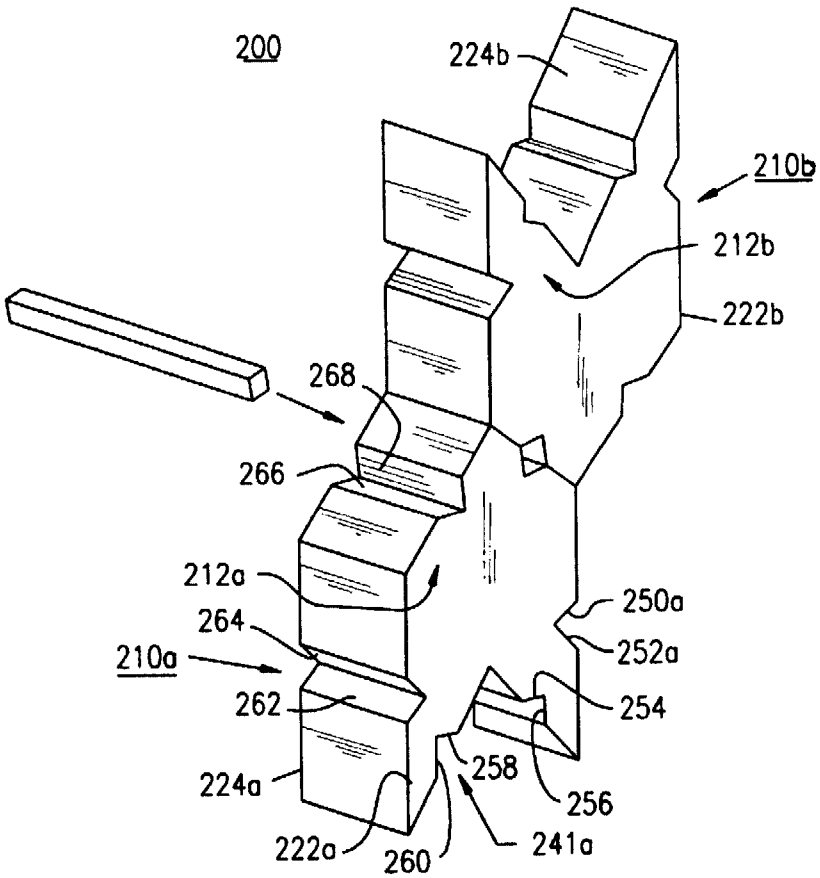
FIG. 5 is a perspective view of the toy building block set of the second alternate embodiment of the present invention showing a pair of solid building blocks being joined by a square shaped connecting rod-like member.

The first alternate embodiment of toy building block set 100 is depicted in detail in FIG. 4 of the drawings. Toy building block set 100 includes a plurality of hollow building blocks 110*a* and 110*b* each having a hollow center 112 with front and rear perimeter edges 122 and 124, and side walls 126, 128, 130, 132, 134, and 136 that are integrally connected with each other to form the specific geometric form of hollow building block 110. Each sidewall 126, 128, 130, 132, 134, and 136 includes a centrally located, semi-circular shaped channel 146, 148, 150, 152, 154, and 156 respectively. Thusly, when two or more of building blocks 110*a* and 110*b* are joined and placed in adjacent contact with each other, as shown in FIG. 4, the side walls 126*a* and 126*b* are adjacently facing and in contact with each other which then matches the semicircular shaped channels 146*a* and 146*b* to form a circular opening 160. The hollow building blocks 110 of toy set 100 can be made of construction materials that include plastic or metal. Connecting rod member 170, as shown in FIG. 5, has a circular outer surface 172 with semi-circular shaped sections 172*a* and 172*b* for fitting into semi-circular channels 146*a* and 146*b* of opening 160 on the aligned building blocks 110*a* and 110*b*. Connecting rod member 170 includes a hollow center 174; and can be made of construction materials that include durable rigid plastic or light-weight metals such as aluminum. In all other respects, toy set 100 functions in the same manner as in the preferred embodiment 10 of the present invention.

SECOND ALTERNATE EMBODIMENT 200

The second alternate embodiment of toy building block set 200 is depicted in detail in FIG. 5 of the drawings. Toy building block set 200 includes a plurality of solid building blocks 210*a* and 210*b*, similar in geometric form to building blocks 20 and 110, each having a front surface 212, a rear surface 214 and side surfaces 216, 218, 220, 222, 224, and 226. Each side surface 216 to 226 includes a centrally located, V-shaped channel 228, 229, 230, 231, 232, and 233 having angled walls 236, 238, 240, 242, 244, 246, 248, 250, 252, 254, 256, and 258 contained therein, respectively. Thusly, when two or more of building blocks 210*a* and 210*b* are joined and placed in adjacent contact with each other, as shown in FIG. 5, the side surfaces 216*a* and 216*b* are adjacently facing and in contact with each other, which then matches the V-shaped channels 228*a* and 228*b* to form a diamond/square shaped opening 260 for receipt of a connecting rod member 270.

Connecting rod member 270 is in the form of an elongated, diamond/square shaped rod 272 having outer wall surfaces 274, 276, 278, and 280. As shown in FIG. 5, connecting rod member 270 is used for the placement within one of the diamond/squared shaped openings 260, formed by the matching of V-shaped channels 228*a* and 228*b* of building blocks 210*a* and 210*b*. Thus, outer walls 274 and 276 of rod 272 are adjacent and in contact with angled walls 236*a* and 238*a* of building block 210*a*; and conversely, outer walls 278 and 280 of rod 272 are adjacent and in contact with angled walls 236*b* and 238*b* of building block 210*b*, thereby joining building blocks 210*a* and 210*b* together by connecting rod member 270 within diamond/square shaped opening 260. In all other respects, toy set 200 functions in the same manner as in the preferred embodiment 10 of the present invention.

THIRD ALTERNATE EMBODIMENT 300

Figure 6:
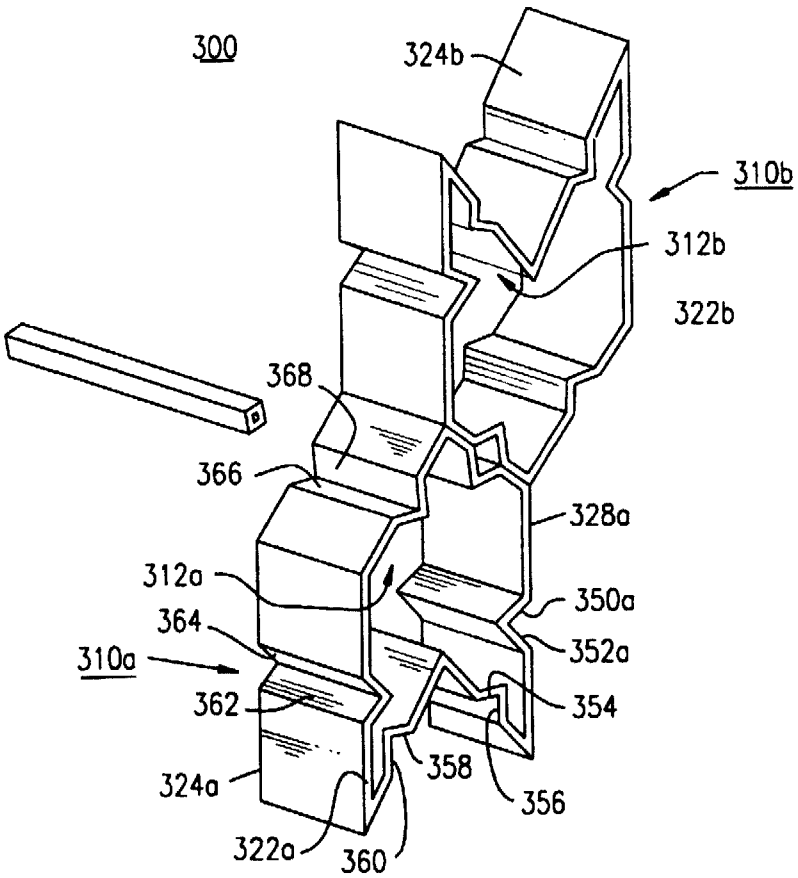
FIG. 6 is a perspective view of the toy building block set of the third alternate embodiment of the present invention showing a pair of hollow building blocks being joined by a square shaped connecting rod-like member.

The third alternate embodiment of toy building block set 300 is depicted in detail in FIG. 6 of the drawings. Toy building block set 300 includes a plurality of hollow building blocks 310*a* and 310*b*, similar in geometric form to building blocks 20, 110, and 210, each having a hollow center 312 with front and rear perimeter edges 322 and 324, and side walls 326, 328, 330, 332, 334, and 336 that are integrally connected with each other to form the specific geometric form of hollow building blocks 310*a* and 310*b*. Each side wall 326 to 336 includes a centrally located, V-shaped channel 338, 339, 340, 341, 342, and 343 having angled walls 346, 348, 350, 352, 354, 356, 358, 360, 362, 364, 366, and 368 contained therein, respectively. Thusly, when two or more of building blocks 310*a* and 310*b* are joined and placed in adjacent contact with each other, as shown in FIG. 6, the side surfaces 326*a* and 326*b* are adjacently facing and in contact with each other, which then matches the V-shaped channels 338*a* and 338*b* to form a diamond/square shaped opening 370 for receipt of a connecting rod member 380.

Connecting rod member 380 is in the form of an elongated, diamond/square shaped rod 382 having outer wall surfaces 384, 386, 388, and 390; and having a hollow center 392. As shown in FIG. 6, connecting rod member 380 is used for the placement within one of the diamond/squared shaped openings 370, formed by the matching of V-shaped channels 338*a* and 338*b* of building blocks 310*a* and 310*b*. Thus, outer walls 384 and 386 of hollow rod 382 are adjacent and in contact with angled walls 346*a* and 348*a* of building block 310*a*; and conversely, outer walls 388 and 390 of hollow rod 382 are adjacent and in contact with angled walls 346*b* and 348*b* of building block 310*b*, thereby joining building blocks 310*a* and 310*b* together by connecting rod member 380 within diamond/square shaped opening 370. In all other respects, toy set 300 functions in the same manner as in the preferred embodiment 10 of the present invention.

FOURTH ALTERNATE EMBODIMENT 400

Figure 7:
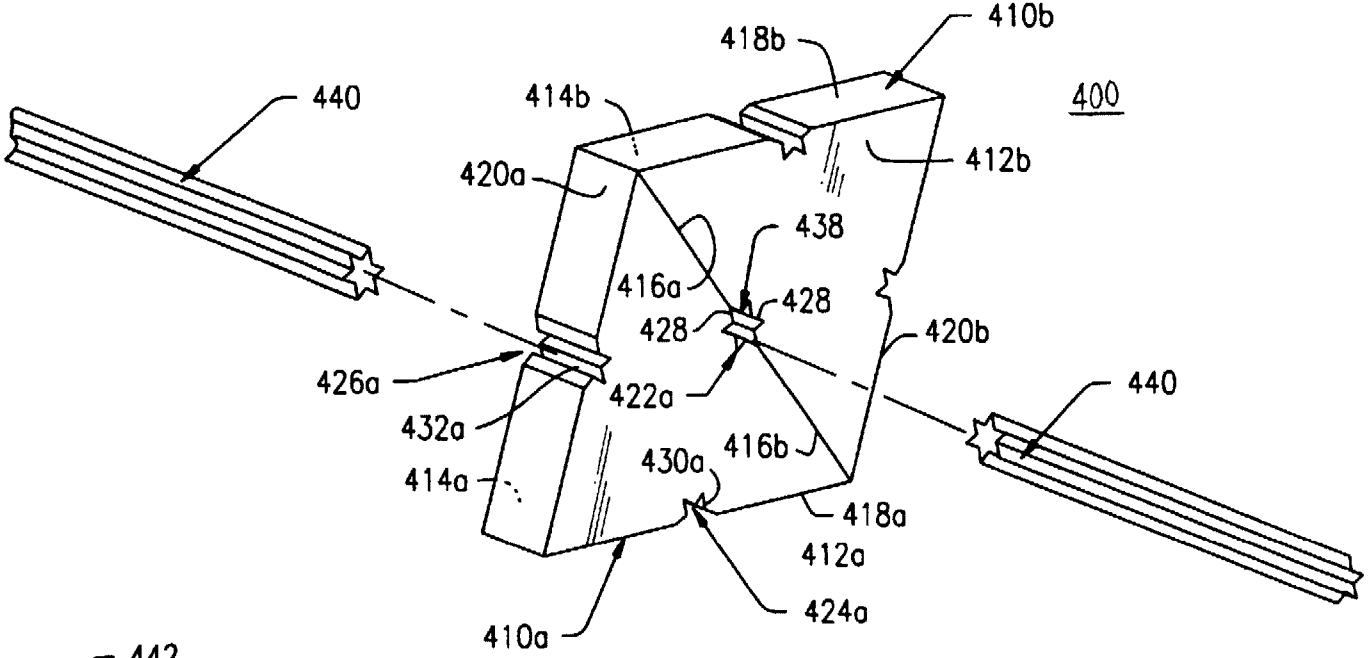
FIG. 7 is a perspective view of the toy block set of the fourth alternate embodiment of the present invention showing a pair of solid triangular shaped building blocks being joined by a pair of star-shaped connecting rod-like members.
Figure 7A:
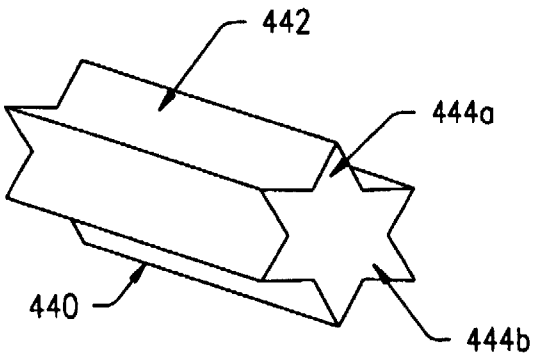
FIG. 7A is an enlarged partial perspective view of the toy block set of the fourth alternate embodiment of the present invention showing the star-shaped connecting rod-like member in detail.

The fourth alternate embodiment of toy building block set 400 is depicted in detail in FIGS. 7 and 7A of the drawings. Toy building block set 400 includes a plurality of solid building blocks 410*a* and 410*b* having a geometric structure in the form of triangular block. Each triangular block 410*a* and 410*b* include a front surface 412, a rear surface 414 and side surfaces 416, 418, and 420. Each side surface 416, 418, and 420 includes a centrally located, saw-tooth channel 422, 424, and 426, respectively; and each saw-tooth channel 422, 424, and 426 has a plurality of angled walls 428, 430, and 432 contained therein, as depicted in FIG. 7.

As shown in FIG. 7, when two saw-tooth channels 422*a* and 422*b* are joined and placed together, the angled walls 428*a* and 428*b* form a star-shaped opening 460 for receipt of a star-shaped, elongated connecting rod member 440. The joining and placing together in any combination of the aforementioned saw-tooth channels 422 to 426; 526 to 532; 626 to 636; 726 to 740; and 836 to 846 of building blocks 410, 510, 610, 710, and 810 will form a star-shaped opening 460 for receipt of connecting rod member 440.

Figure 9:
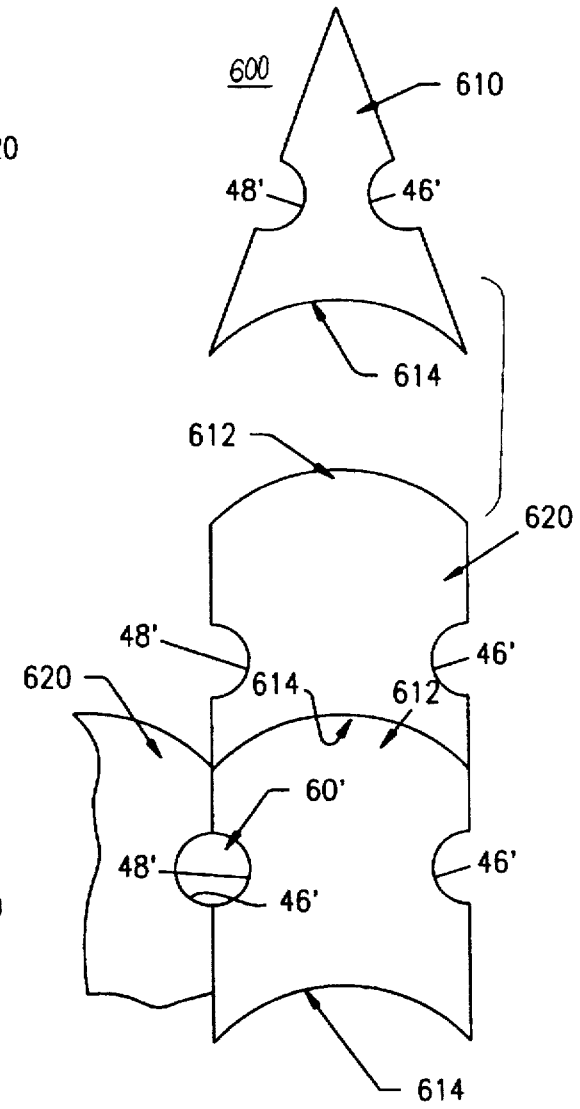
FIG. 9 is a front view of the toy building block set of the sixth alternate embodiment of the present invention showing a plurality of triangular and rectangular shaped building blocks having interfitting convex and concave sections thereon.

Star-shaped, elongated connecting rod member 440, as shown in FIG. 7A, includes an angled wall outer surface 442 with a sawtooth first section 444*a* and a saw-tooth second section 444*b*. For example, first section 444*a* of rod 440 fits into the angled walls 428*a* of building block 410*a*; and conversely, second section 444*b* or rod 440 fits into the angled walls 428*b* of building block 410*b*, thereby joining building blocks 410*a* and 410*b* together by connecting rod member 440 within star-shaped opening 460, as depicted in FIG. 9.

Building blocks 410*a* and 410*b*; and connecting rod member 440 can be made from materials that include plastic, metal, wood, or ceramic.

FIFTH ALTERNATE EMBODIMENT

Figure 8:
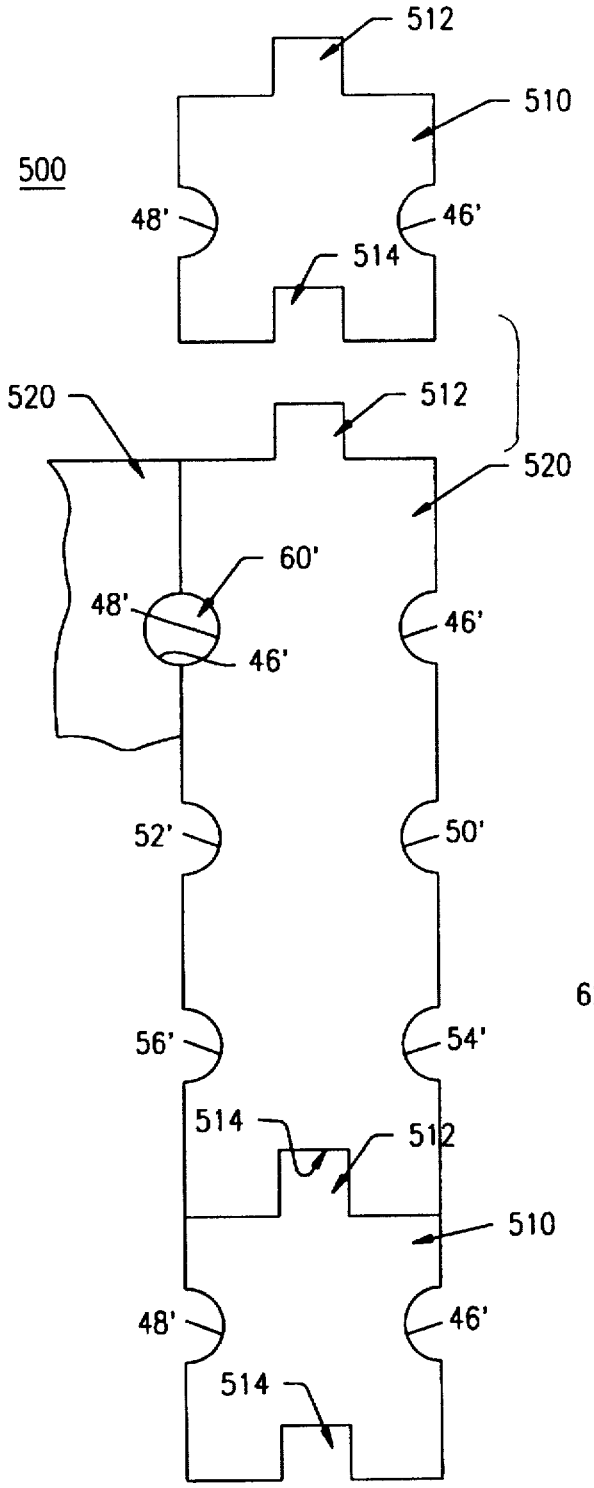
FIG. 8 is a front view of the toy building block set of the fifth alternate embodiment of the present invention showing a plurality of rectangular shaped building blocks having interfitting tabs and tab-receiving channels thereon.

The fifth alternate embodiment of toy building block set 500 is depicted in detail in FIG. 8 of the drawings. These alternate block shapes 510 and 520 can be used in any of the previous embodiments, as they have centrally located, semi-circular shaped channels 46', 48', 50', 52', 54', and 56'; such that when each shaped channel 46' to 56' is matched and joined together, it forms the circular opening 60' for receiving the cylindrical connecting rod member 70. This embodiment 500, in addition, can use connecting channels and connecting rods of any of the shapes shown in the previous embodiments. Further, as shown in FIG. 8, blocks 510 and 520 include a rectangular shaped tab 512 and a rectangular shaped channel 514 for interfitting with each other, such that when they interfit with each other, there is more stability to a finite block formation when joining the plurality of blocks 510 and 520 together.

SIXTH ALTERNATE EMBODIMENT

The sixth alternate embodiment of toy building block set 600 is depicted in detail in FIG. 9 of the drawings. These alternate block shapes 610 and 620 can be used in any of the previous embodiments, as they have centrally located, semi-circular shaped channels 46' and 48'; such that when each shaped channel 46' and 48' is matched and joined together, it forms the circular opening 60' for receiving the cylindrical connecting rod member 70. This embodiment 600, in addition, can use connecting channels and connecting rods of any of the shapes shown in the previous embodiments. Further, as shown in FIG. 9, blocks 610 and 620 include a convex section 612 and concave section 614 for interfitting with each other, such that when they interfit with each other, there is more stability to a finite block formation when joining the plurality of blocks 610 and 620 together.

SEVENTH ALTERNATE EMBODIMENT

Figure 10:
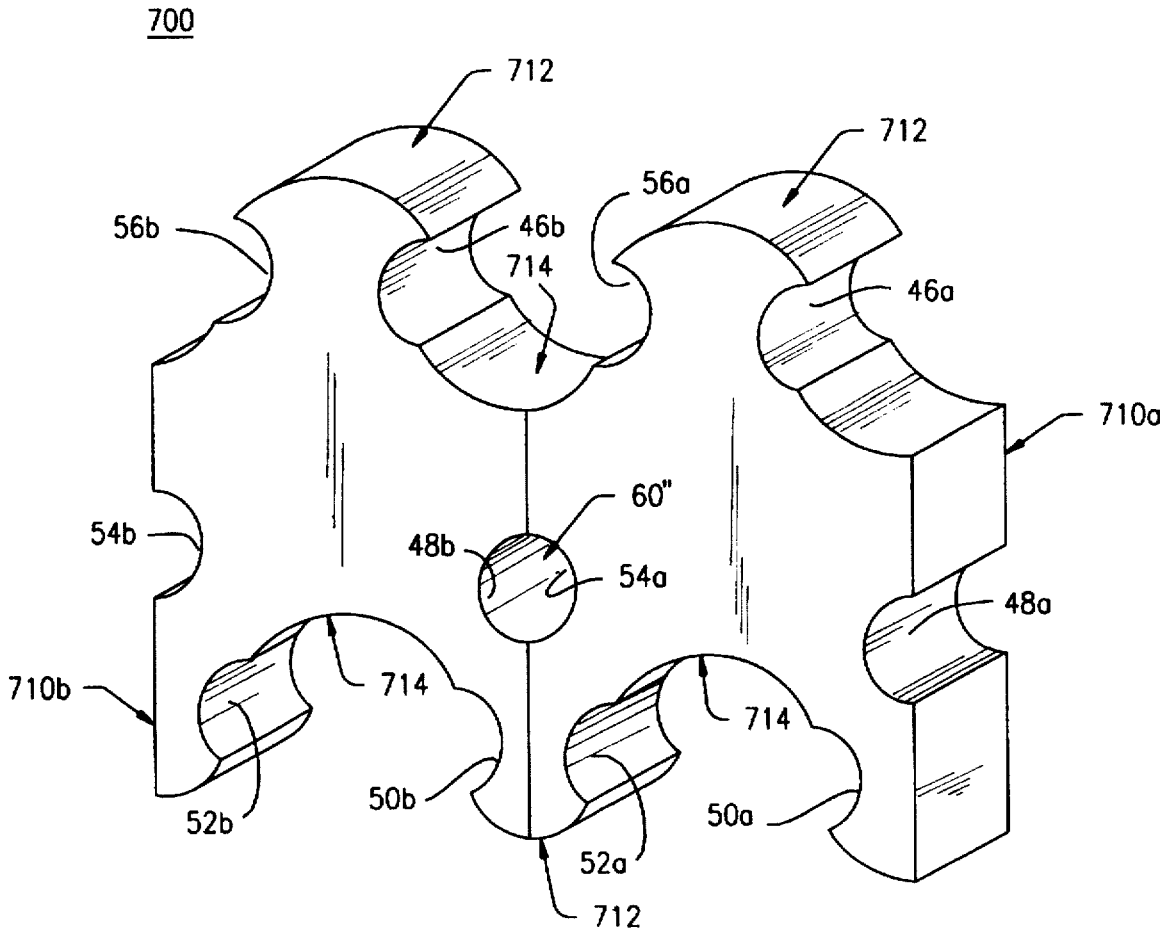
FIG. 10 is a front perspective view of the toy building block set of the seventh alternate embodiment of the present invention showing a pair of geometric shaped blocks having interfitting convex tab sections and concave tab-receiving channels thereon.

The seventh alternate embodiment of toy building block set 700 is depicted in detail in FIG. 10 of the drawings. These alternate block shapes 710*a* and 710*b* can be used in any of the previous embodiments, as they have centrally located, semi-circular shaped channels 46*a*, 48*a*, 50*a*, 52*a*, 54*a*, 56*a*, 46*b*, 48, 50*b*, 52*b*, 54*b*, and 56*b*. As described in the previous embodiments, when the channels are matched and joined together, they form the circular opening 60" for receiving the cylindrical connecting rod member 70. This embodiment 700, in addition, can use connecting channels and connecting rods of any of the shapes shown in the previous embodiments. Further, as shown in FIG. 10, blocks 710*a* and 710*b* each include convex tab sections 712 and concave tab-receiving sections 714 for interfitting with each other, such that when they interfit with each other, there is more stability to a finite block formation when joining the plurality of blocks 710 together.

OPERATION OF THE PRESENT INVENTION

In operation, the user can assemble in any desired manner the building blocks 20, 110, 210, 310, 410, 510, 520, 610, 620, and 710 of toy sets 10, 100, 200, 300, 400, 500, 600, and 700 to make any desired structural configuration 12, 402, or 404, as depicted in FIGS. 1, 7, and 8. Similarly, the connecting rod members 70, 170, 270, 380, and 440 can be placed in any of the hole openings 60, 60', 60", 160, 260, 370, or 460 to construct the desired structural configuration 12, 402, or 404, as shown in FIGS. 1, 7, 8, 9, and 10.

In the actual construction of the desired structural configuration 12 as by example, the user places a plurality of building blocks 20*a* to 20*g* on a section 96 of the support member 80 and then another plurality of building blocks 20*h* to 20*n* on another section 98 of the support member 80. The aforementioned building blocks 20*a* to 20*g* and 20*h* to 20*n* are then connected with each other by a series of connecting rods 70*a*, 70*b*, and 70*c* via hole openings 60. Connecting rods 70*a*, 70*b*, and 70 provide structural integrity to the configuration 12 that was formed, such that the aligned blocks 20*a* through 20*n* will not slide apart or tumble if more building blocks 20 were to be added to the configuration 12.

In all other respects toy sets 100, 200, 300, 400, 500, 600, and 700 operate and function in the same manner as in the preferred embodiment 10 of the present invention.

ADVANTAGES OF THE PRESENT INVENTION

Accordingly, an advantage of the present invention is that it provides for a building block toy set that is easy to use where interconnection of two or more building blocks is done by the use of connecting rod member.

Another advantage of the present invention is that it provides for a building block toy having a grooved side for connecting with a rod member in which to join two or more building blocks together for creating an infinite number of structural designs.

Another advantage of the present invention is that it provides for a building block toy set wherein the building blocks are in the geometric shapes of triangles, cubes, rectangles, trapezoids, parallelograms, and polygons.

Another advantage of the present invention is that it provides for a building block toy set wherein the building blocks are solid or hollow and are mode of materials such as plastic, metal, ceramic or wood.

Another advantage of the present invention is that it provides for a building block toy set wherein the connecting rod member has a cross-sectional geometric shape of a circle, oval, square, rectangle, parallelogram, octagon, star, and even-sided polygon.

Another advantage of the present invention is that it provides for a building block toy set wherein the connecting rod members are solid or hollow and are made of materials such as plastic, metal, ceramic or wood.

A further advantage of the present invention is that it provides for a building block toy set wherein the use of the connecting rod members enables the builder to extend the connecting rod members from a toy set of aligned building blocks to support other aligned building blocks within the same toy set.

A still further advantage of the present invention is that it provides for a building block toy set which can be mass produced in an automated and economical manner; is very durable and long lasting; and is readily affordable by the consumer.

A latitude of modification, change, and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A toy block set, comprising:

a) a plurality of building blocks each having a plurality of sides for interfitting with each other;

b) at least one side of each building block having a semicircular-shaped channel formed therein for alignment with the semicircular-shaped channel of another building block of said plurality of building blocks to form a circular channel;

c) each of said building blocks including an extending section and a recessed opening having a shape complementary to said extending section, said extending section of one building block configured for interfitting with the recessed opening of another building block of said plurality of building blocks; and d) a plurality of cylindrical rod-like members each configured for placement in one of said circular channels when said building blocks are aligned, and for extending from said aligned building blocks to support other building blocks in said plurality of building blocks.

2. A toy block set in accordance with claim 1, wherein said building blocks each have 6 sides.

3. A toy block set in accordance with claim 1, wherein each side of said building blocks has at least one semicircular-shaped channel formed therein.

4. A toy block set in accordance with claim 3, wherein at least one side of said building blocks has two semicircular-shaped channels formed therein.

5. A toy block set in accordance with claim 1, wherein said cylindrical rod-like member has a length of at least 4 inches.

6. A toy block set in accordance with claim 1, wherein said building blocks are solid.

7. A toy block set in accordance with claim 1, wherein said building blocks are hollow.

8. A toy block set in accordance with claim 1, wherein said building blocks are made from plastic, wood, metal, or ceramic material.

9. A toy block set in accordance with claim 1, wherein said building blocks are in the shape of a polygon.

10. A toy block set in accordance with claim 1, further including an accordion-shaped support member having a plurality of angled walls for supporting said building blocks.

11. A toy block set, comprising:

a) a plurality of building blocks each having a plurality of sides for interconnection with each other;

b) at least one side of each building block having a partial channel formed therein for alignment with the partial channel of another building block of said plurality of building blocks to form a complete channel;

c) each of said building blocks including an extending section and a recessed opening when said building blocks are aligned, said extending section of one building block configured for interfitting with the recessed opening of another building block of said plurality of building blocks; and d) a plurality of rod-like members each configured for placement in one of said complete channels of said aligned building blocks and for extending from said aligned building blocks to support other building blocks in said plurality of building blocks.

12. A toy block set in accordance with claim 11, wherein said building blocks each have 6 sides.

13. A toy block set in accordance with claim 11, wherein each side of said building blocks has at least one partial channel formed therein.

14. A toy block set in accordance with claim 13, wherein at least one side of said building blocks has two partial channels formed therein.

15. A toy block set in accordance with claim 11, wherein said rod-like member has a length of at least ¾ inches.

16. A toy block set in accordance with claim 11, wherein said building blocks are solid.

17. A toy block set in accordance with claim 11, wherein said building blocks are hollow.

18. A toy block set in accordance with claim 11, wherein said building blocks are made from plastic, wood, metal, or ceramic material.

19. A toy block set in accordance with claim 11, wherein said building blocks are in the shape of a polygon.

20. A toy block set in accordance with claim 11, further including an accordion-shaped support member having a plurality of angled walls for supporting said building blocks.

21. A toy block set in accordance with claim 11, wherein said rod-like members each have a cylindrical shape and wherein said complete channels are cylindrical in shape and wherein said partial channels are semi-circular in shape.

22. A toy block set in accordance with claim 11, wherein said plurality of building blocks have more than one shape.

23. A toy block set in accordance with claim 11, wherein said extending section is a rectangular shaped tab and said recessed opening is a rectangular shaped channel.

24. A toy block set in accordance with claim 11, wherein said extending section is a convex shaped section and said recessed opening is a concave shaped section.

25. A toy block set in accordance with claim 11, wherein said extending section is triangular in shape and said recessed opening is triangular in shape.

* * * * *